US007786363B1

(12) United States Patent
Wei

(10) Patent No.: US 7,786,363 B1
(45) Date of Patent: Aug. 31, 2010

(54) ANNULAR DRUM HOOP FOR A DRUM

(75) Inventor: Guo-Hsiung Wei, Lu Chou (TW)

(73) Assignee: K.H.S. Musical Instrument Co., Ltd., Lu Chou (TW)

( * ) Notice: Subject to any disclaimer, the term of this patent is extended or adjusted under 35 U.S.C. 154(b) by 0 days.

(21) Appl. No.: 12/565,831

(22) Filed: Sep. 24, 2009

(51) Int. Cl.
*G10D 13/02* (2006.01)

(52) U.S. Cl. ..... 84/411 R

(58) Field of Classification Search ..... 84/411 R, 84/413, 421, 411 A
See application file for complete search history.

(56) References Cited

U.S. PATENT DOCUMENTS 7,495,160 B2 * 2/2009 Hoshino et al. ..... 84/411 R

* cited by examiner

*Primary Examiner*—Kimberly R Lockett
(74) *Attorney, Agent, or Firm*—Alan Kamrath; Kamrath & Associates PA

(57) ABSTRACT

An annular drum hoop for a drum having a cylindrical drum shell, two drumheads and multiple tension control devices and the annular drum hoop has an outer ring, a mounting segment, an inner ring, multiple holding mounts and a curved segment. The mounting segment is formed on the outer ring. The inner ring is formed annularly on the mounting side of the annular drum hoop and is formed with the mounting segment. The holding mounts are formed on the annular drum hoop between the mounting segment and the inner ring at intervals and each holding mount has a through hole formed through the holding mount to mount on one of the tension control devices. The curved segment is formed on and protrudes inwards from the free edge of the outer ring and has an inner surface, a curved outer surface and an engaging groove formed in the inner surface.

2 Claims, 7 Drawing Sheets

ANNULAR DRUM HOOP FOR A DRUM

BACKGROUND OF THE INVENTION

1. Field of the Invention

The present invention relates to an annular drum hoop, and more particularly relates to an annular drum hoop for a drum that can restrain noise and echo when the drum is beaten.

2. Description of Related Art

With reference to FIGS. 5 and 6, a conventional drum normally comprises a cylindrical drum shell (A), two drumheads (B), two annular drum hoops (2), and multiple tension control devices (C). The cylindrical drum shell (A) includes two round openings and an outer surface. The drumheads (B) are mounted respectively in the annular drum hoops (2), cover the two openings of the cylindrical drum shell (A) and generate a tone depending on tension of the drumheads (B).

The annular drum hoops (2) are made of iron or zinc alloy, the common products name is Power Hoop or a zinc alloy hoop and are mounted respectively around the drumheads (B), and each annular drum hoop (2) is made of metal by a punching process and has a free side, a mounting side, an outer ring (20), a mounting segment (21), an inner ring (22), multiple holding mounts (23) and an extending flange (24). The outer ring (20) is formed annularly on the free side of the annular drum hoop (2) and has a mounting edge and a free edge. The mounting segment (21) is formed on the mounting edge of the outer ring (20), is mounted around one of the openings of the cylindrical drum shell (A) and presses against the corresponding drumhead (B). The inner ring (22) is formed annularly on the mounting side of the annular drum hoop (2), is formed with the mounting segment (21) opposite to the outer ring (20). The holding mounts (23) are formed on the annular drum hoop (2) at intervals between the mounting segment (21) and the inner ring (22). The extending flange (24) is formed on and protrudes outwards from the free edge of the outer ring (20) and has a sharp outer edge (241).

The tension control devices (C) are mounted on the outer surface of the cylindrical drum shell (A) between the annular drum hoops (2) and are connected respectively to aligned holding mounts (23) on the annular drum hoops (2) to adjust the tone of the drum by changing the tensions of the drumheads (B).

When beating the conventional drum using drumsticks, the extending segment (24) formed on and protruding outward from the free edge of the outer ring (20) will resonate with the drumheads (B), but this will cause the conventional drum to generate a drumbeat with an echo and noise. Furthermore, the drumsticks may be worn off when the drumsticks knock against the sharp outer edge (241) of the extending segment (24) of the annular drum hoop (2) and this will shorten the useful life of the drumsticks. In addition, the cost of the zinc alloy hoop is expensive than the iron drum.

Therefore, the invention provides an annular drum hoop for a drum to mitigate or obviate the aforementioned problems.

SUMMARY OF THE INVENTION

The main objective of the present invention is to provide an annular drum hoop for a drum that can restrain the noise and the echo when beating the drum.

The annular drum hoop in accordance with the present invention is used on a drum having a cylindrical drum shell, two drumheads and multiple tension control devices and the annular drum hoop has an outer ring, a mounting segment, an inner ring, multiple holding mounts and a curved segment. The mounting segment is formed on the outer ring to mount around the cylindrical drum shell and to press against one of the drumheads. The inner ring is formed annularly on the mounting side of the annular drum hoop and is formed with the mounting segment opposite to the outer ring. The holding mounts are formed on the annular drum hoop between the mounting segment and the inner ring at intervals and each holding mount has a through hole formed through the holding mount to mount on one of the tension control devices. The curved segment is formed on and protrudes inwards from the free edge of the outer ring and has an inner surface, a curved outer surface and an engaging groove formed in the inner surface.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
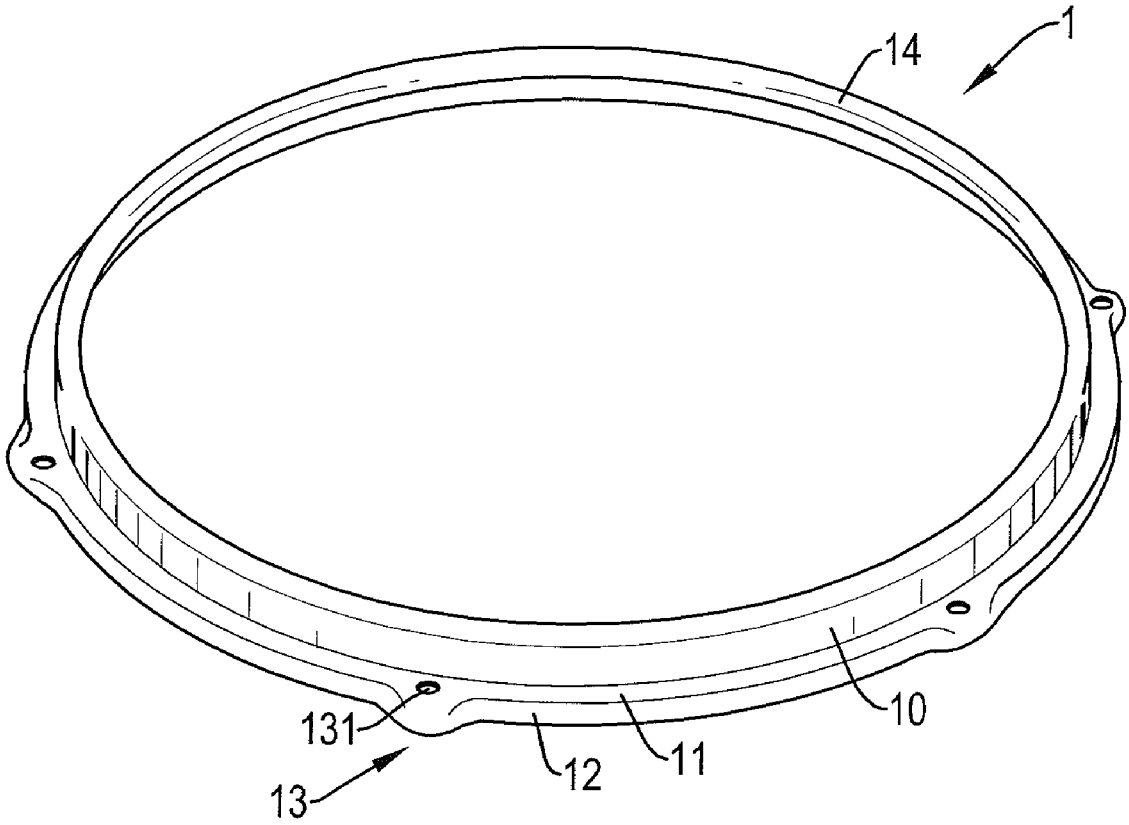
FIG. 1 is a perspective view of an annular drum hoop in accordance with the present invention.
Figure 2:
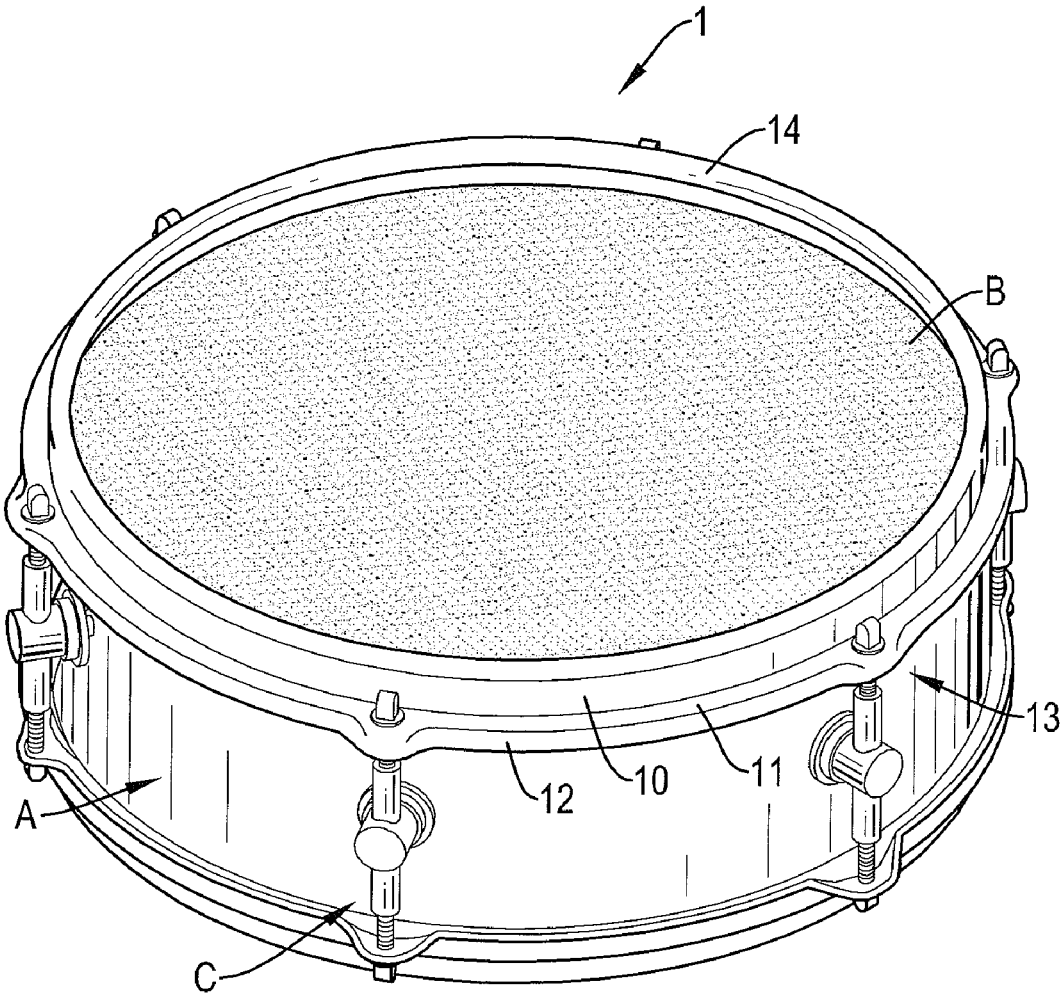
FIG. 2 is a perspective view of a drum with two annular drum hoops in FIG. 1.
Figure 3:
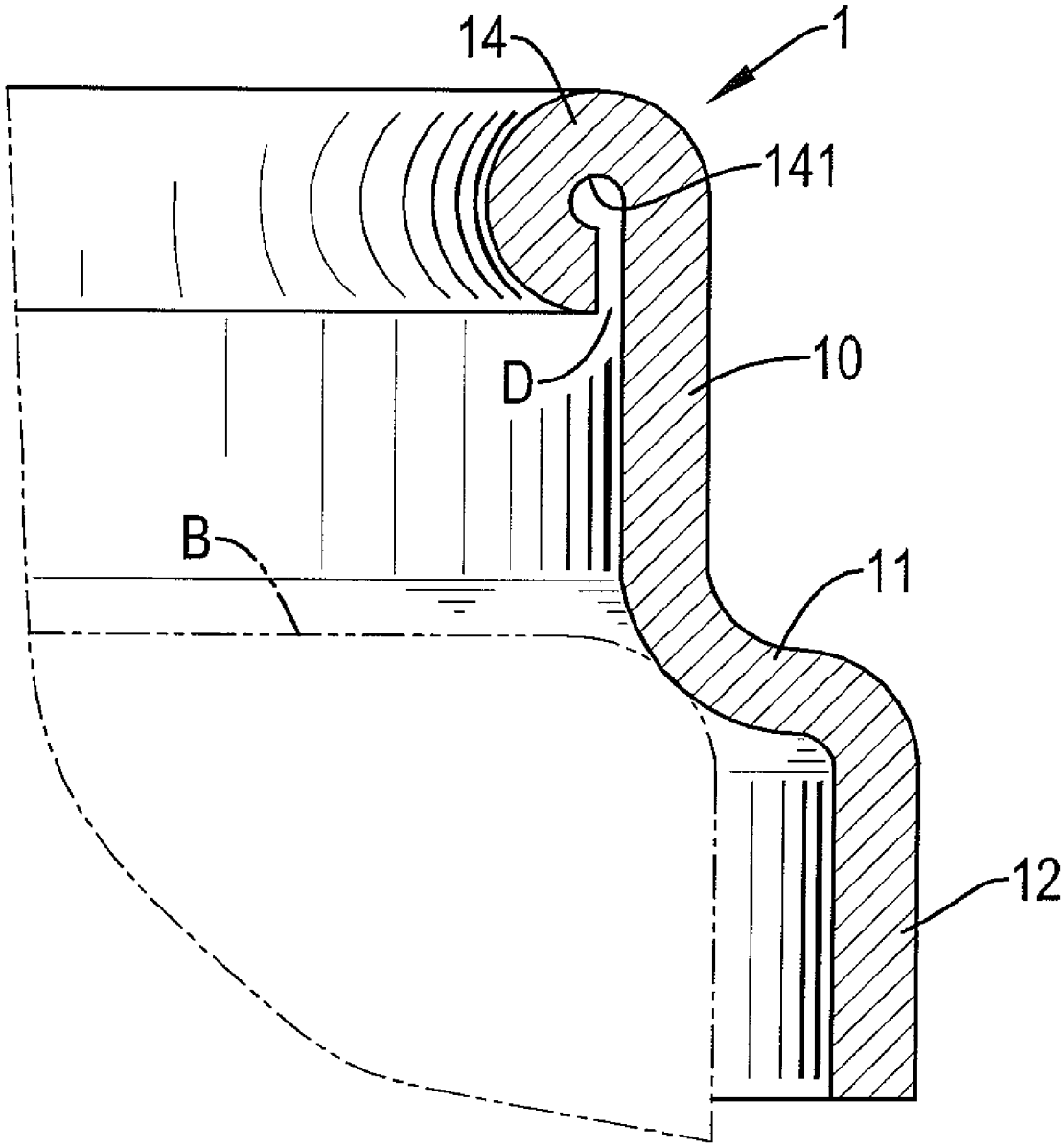
FIG. 3 is an enlarged cross section side view of the annular drum hoop in FIG. 2.

With reference to FIGS. 1 to 3, an annular drum hoop (1) in accordance with the present invention is used on a drum having a cylindrical drum shell (A), two drumheads (B) and multiple tension control devices (C), and comprises a free side, a mounting side, an outer ring (10), a mounting segment (11), an inner ring (12), multiple holding mounts (13) and a curved segment (14).

The cylindrical drum shell (A) has two opposite sides, two openings, an outer surface and two engaging flanges (D). The openings are respectively formed through the opposite sides of the cylindrical drum shell (A) and communicate with each other. The engaging flanges (D) are respectively formed on and protrude from the opposite sides of the cylindrical drum shell (A) around the openings. The drumheads (B) are mounted around the openings of the cylindrical drum shell (A). The tension control devices (C) are mounted on the outer surface of the cylindrical drum shell (A)

The outer ring (10) is annular, is formed on the free side of the annular drum hoop (1) and has a mounting edge and a free edge.

The mounting segment (11) is formed on the mounting edge of the outer ring (10), is mounted around one of the openings of the cylindrical drum shell (A) and presses against the corresponding drumhead (B).

The inner ring (12) is formed annularly on the mounting side of the annular drum hoop (1) and is formed with the mounting segment (11) opposite to the outer ring (10).

The holding mounts (13) are formed on the annular drum hoop (1) at intervals between the mounting segment (11) and the inner ring (12), and each holding mount (13) has a through hole (131). The through hole is formed through the holding mount (13) and is mounted around a corresponding tension control device (C). Preferably, the annular drum hoop (1) may have six holding mounts (13) formed between the mounting segment (11) and the inner ring (12).

The curved segment (14) is formed on and protrudes inwards from the free edge of the outer ring (10) and has an inner surface, an outer surface and an engaging groove (141). The outer surface of the curved segment (14) is curved. The engaging groove (141) is formed in the inner surface of the curved segment (14) and is mounted around one of the engaging flanges (D) of the cylindrical drum shell (A) to connect the annular drum hoop (1) securely to the cylindrical drum shell (A).

Furthermore, the experimental result is shown the sound characteristics between the annular drum hoop (1) in accordance with the present invention, the zinc alloy hoop and the iron drum:

First ↑ the Experiment Purpose:

1. To test the sound difference between the drums that aforementioned.

2. The kinds of the drums influence the length of the portamento.

Second ↑ the Testing Sample:

1. A bronze drumhead with sizes 14↑×5.5↑ and includes:

an upper drumhead of the bronze drumhead: weatherking coated ambassador; and a lower drumhead of the bronze drumhead: weatherking ambassador snare.

2. A Power hoop.

3. An annular drum hoop in accordance with the present invention.

4. A zinc alloy hoop.

5. The tension of the bronze drumhead:

the tension of the bronze drumhead of the Power hoop, the annular drum hoop and the zinc alloy hoop are the same, and the tension of the upper drumhead is 95 lb/ft and the tension of the lower drumhead is 85 lb/ft.

Figure 7:
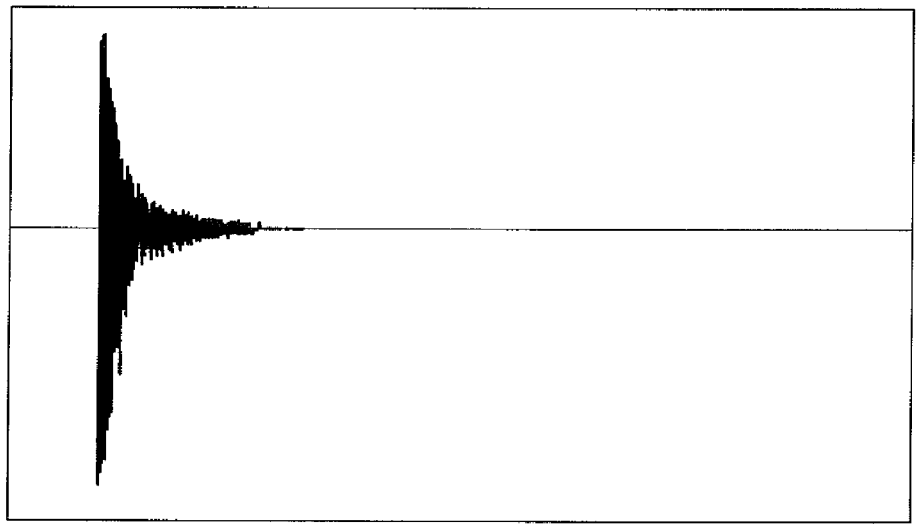
FIG.7 PRIOR ART
FIG. 7 is a sound waveform diagram of a Power hoop drum in accordance with the prior art.

Third ↑ the Power Hoop:

The sound waveform diagram of the Power hoop drum as shown in FIG. 7, the Power hoop is made of iron:

1. The sound length: 1.24 seconds.

2. The echo of the Power Hoop is large, the intermediate frequency and the low frequency of the Power Hoop are more than the high frequency.

3. The sound of the drum is clear and the echo and the portamento of the Power Hoop are large.

4. The iron Power Hoop can not cover the resonance of the bronze drumhead.

5. The range of the Power Hoop's sound is broad, the bronze drumhead is resonated mightily with the Power Hoop and the sound of the Power Hoop belongs to an inattentive and natural form.

Figure 4:
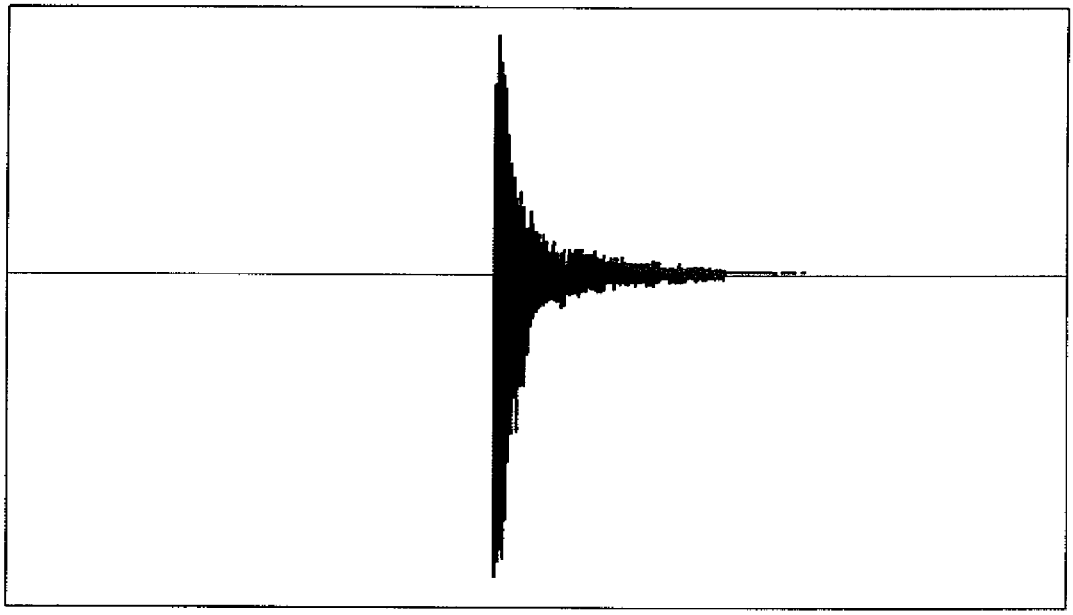
FIG. 4 is a sound waveform diagram of the annular drum hoop in FIG. 1.
Figure 5:
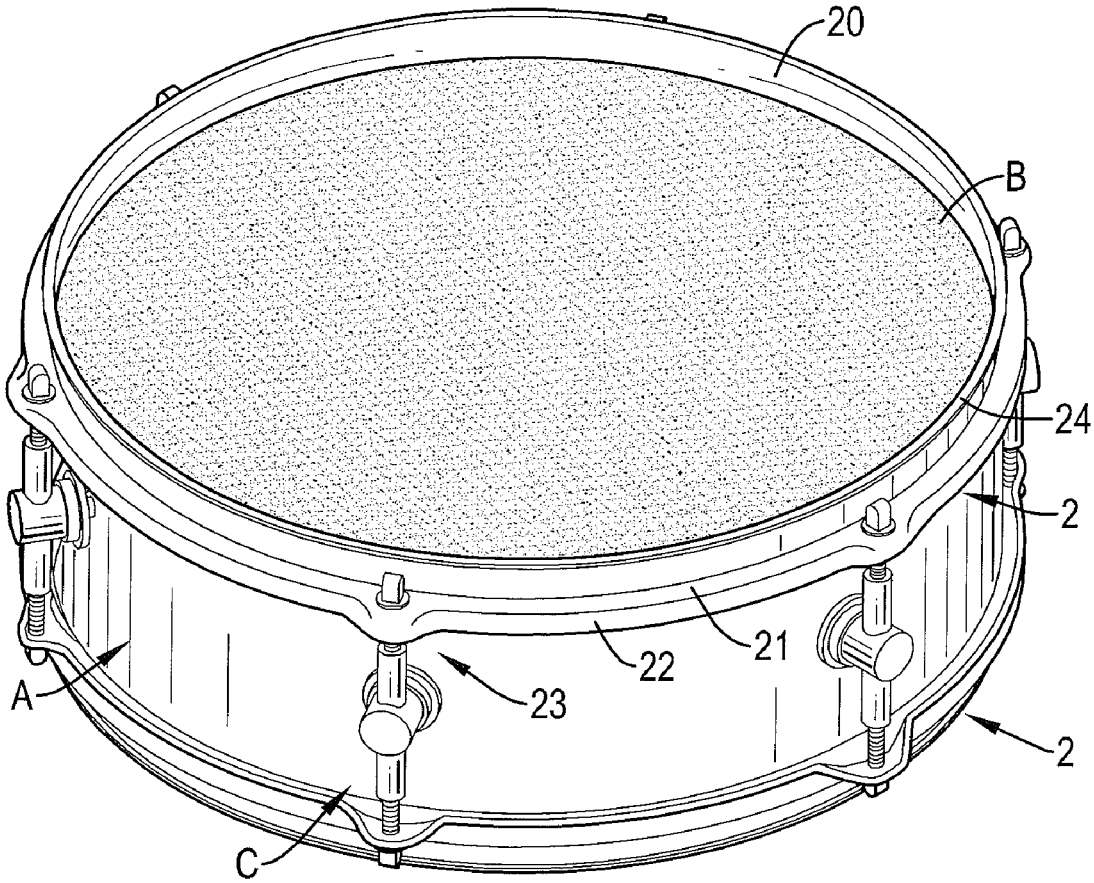
FIG.5 PRIOR ART
FIG. 5 is a perspective view of a drum with two conventional annular drum hoops in accordance with the prior art.
Figure 6:
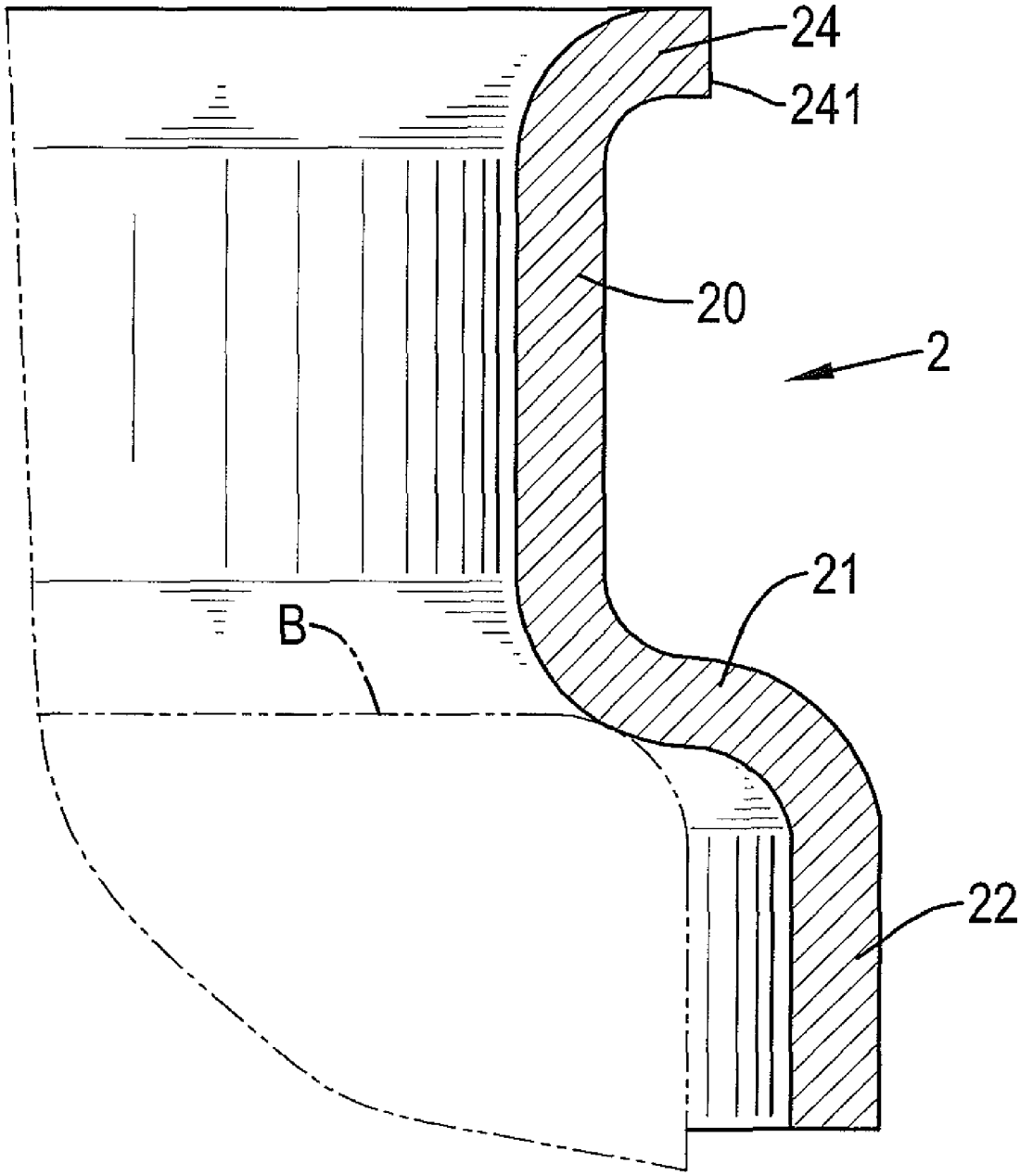
FIG.6 PRIOR ART
FIG. 6 is an enlarged cross sectional side view of the conventional annular drum hoop in FIG. 4.

Fourth ↑ the Annular Drum Hoop (1):

The sound waveform diagram of the annular drum hoop as shown in FIG. 4, the annular drum hoop is made of iron:

1. The sound length: 1.16 seconds.

2. The echo of the Power Hoop is moderate, the high frequency, the intermediate frequency and the low frequency of the annular drum hoop are moderate.

3. The sound waveform lines are smoothly to provide an integrated resonance and the end syllable will not disappear.

4. The iron annular drum hoop is bend annularly and this can provide a sound-offset effect, the resonance of the bronze drumhead can be slightly covered by the annular drum hoop and the noise and the echo can be slightly modified by the annular drum hoop.

5. The sound of the annular drum hoop belongs to a warm and moderate form.

Figure 8:
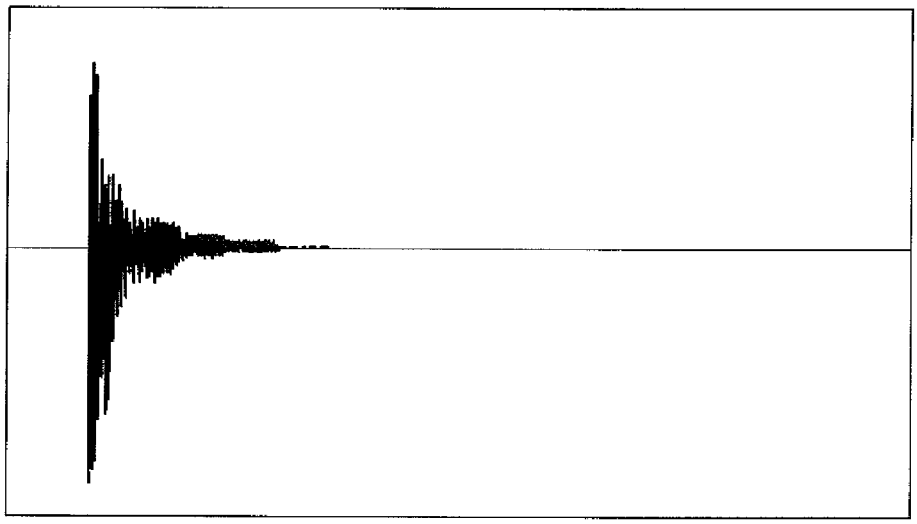
FIG.8 PRIOR ART
FIG. 8 is a sound waveform diagram of a zinc alloy hoop in accordance with the prior art.

Fifth ↑ the Zinc Alloy Hoop:

The sound waveform diagram of the zinc alloy hoop as shown in FIG. 8:

1. The sound length: 0.937 seconds.

2. The echo of the zinc alloy hoop is short, the high frequency is more than the intermediate frequency and the low frequency and the sound of the zinc alloy hoop is ragged.

3. The zinc alloy hoop can cover most of the resonance of the bronze drumhead.

4. The sound of the drum is not clear and the sound of the bronze drumhead is clear.

5. The sound of the annular drum hoop belongs to a violent and strong form.

Sixth ↑ Compare the Sounds of the Power Hoop, the Annular Drum Hoop and the Zinc Alloy Hoop:

1. the sound frequency (high to low): the zinc alloy hoop, the annular drum hoop and the Power hoop.

2. the resonance (strong to weak): the Power hoop, the annular drum hoop and the zinc alloy hoop.

3. the portamento (long to short): the Power hoop, the annular drum hoop and the zinc alloy hoop.

4. the sound forms (violent to moderate): the zinc alloy hoop, the Power hoop and the annular drum hoop.

5. the sound specialty (specific to normal): the annular drum hoop, the zinc alloy hoop and the Power hoop.

6. the hoop exterior (specific to normal): the annular drum hoop, the zinc alloy hoop and the Power hoop.

Seventh ↑ Conclusion 1. the drumhead will produce different sounds when mounted with different hoops, and the sound like and dislike of each person is different. So the sound of the different hoops can not be determined what is good or what is bed.

2. the annular drum hoop has a specific sound and a specific exterior and can improve the quality of products.

3. the sound that produced by the annular drum hoop can cover the noise and the echo of the drumhead without covering the sound of the drumhead.

After the experiment of comparing with the annular drum hoop, the Power Hoop and the zinc alloy hoop, the sound frequency, the resonance and the portamento of the annular drum hoop are between the Power Hoop and the zinc alloy hoop. The sound form of the annular drum hoop is more moderate than the Power Hoop and the zinc alloy hoop. The sound specialty of the annular drum hoop is more specific than the Power Hoop and the zinc alloy hoop. Besides, the shape of the curved segment (14) of the outer ring (10) is annular and has a specific exterior than the Power Hoop and the zinc alloy hoop. In addition, the annular drum hoop (1) of the present invention is made of iron and this can provide a cheaper cost of buying the annular drum hoop (1).

The annular drum hoop (1) as described has the following advantages.

1. The curved segment (14) is formed on and protrudes inwards from the free edge of the outer ring (10) and a space is formed between the curved segment (14) and the outer ring (10). When a drumstick beats the drum, the sound will transmit circuitously in the space between the curved segment (14) and the outer ring (10) and this can restrain the noise and the echo of the drum.

2. The outer surface of the curved segment (14) of the annular drum hoop (1) is a curved and smooth surface, and the drumsticks will not easily be worn off when the drumsticks knock against the curved segment (14). Consequently, the useful life of the drumstick will be prolonged.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An annular drum hoop for a drum having a cylindrical drum shell, two drumheads and multiple tension control devices, and the annular drum hoop having a free side;

a mounting side;

an outer ring shaped annularly, formed on the free side of the annular drum hoop and having a mounting edge; and a free edge;

a mounting segment formed on the mounting edge of the outer ring to mount around the cylindrical drum shell and to press against one of the drumheads;

an inner ring formed annularly on the mounting side of the annular drum hoop and formed with the mounting segment opposite to the outer ring;

multiple holding mounts formed on the annular drum hoop at intervals between the mounting segment and the inner ring, and each holding mount having a through hole formed through the holding mount to mount around one of the tension control devices; and a curved segment formed on and protruding inwards from the free edge of the outer ring and having an inner surface;

an outer surface having a curved shape; and an engaging groove formed in the inner surface of the curved segment to mount around the cylindrical drum shell.

2. The annular drum hoop as claimed in claim 1, wherein the annular drum hoop has six holding mounts formed between the mounting segment and the inner ring.

* * * * *